US007539427B2

(12) United States Patent
Slattery et al.

(10) Patent No.: US 7,539,427 B2
(45) Date of Patent: May 26, 2009

(54) PRINT QUALITY MAINTENANCE METHOD AND SYSTEM

(75) Inventors: Scott T. Slattery, Brockport, NY (US); Rodney R. Bucks, Webster, NY (US); Richard G. Allen, Rochester, NY (US)

(73) Assignee: Eastman Kodak Company, Rochester, NY (US)

( * ) Notice: Subject to any disclaimer, the term of this patent is extended or adjusted under 35 U.S.C. 154(b) by 347 days.

(21) Appl. No.: 11/453,218

(22) Filed: Jun. 14, 2006

(65) Prior Publication Data

US 2007/0292148 A1 Dec. 20, 2007

(51) Int. Cl.
*G03G 15/00* (2006.01)
*G03G 15/10* (2006.01)

(52) U.S. Cl. ..... 399/44; 399/58; 399/59

(58) Field of Classification Search ..... 399/27, 399/30, 44, 46, 49, 50, 58, 59, 60
See application file for complete search history.

(56) References Cited

U.S. PATENT DOCUMENTS 5,327,196 A * 7/1994 Kato et al. ..... 399/58
5,436,705 A * 7/1995 Raj ..... 399/59
5,504,557 A 4/1996 Morita
5,678,131 A * 10/1997 Alexandrovich et al. ..... 399/58
6,121,986 A 9/2000 Regelsberger et al.
6,175,698 B1 * 1/2001 Scheuer et al. ..... 399/58
6,647,219 B2 11/2003 Buettner
2004/0197110 A1 10/2004 Bessho et al.

FOREIGN PATENT DOCUMENTS

EP 1 439 431 A 7/2004
EP 1 598 710 A 11/2005
JP 08-123110 A 5/1996
JP 11-249408 A 9/1999

* cited by examiner

*Primary Examiner*—Sandra L Brase
(74) *Attorney, Agent, or Firm*—Donna P. Suchy

(57) ABSTRACT

An system and related method for maintaining print quality based on development potential measurements that include comparing the current process measurements to a toner concentration related set-point; calculating a quality adjustment range based on current process measurements and the toner concentration related set-point, or a derivative thereof, indicative of print quality; and adjusting current process conditions related to the current process measurements to trend towards a new set point within the quality adjustment range so that a rate of change is proportional to the difference between the current process measurements and the set point.

22 Claims, 6 Drawing Sheets

PRINT QUALITY MAINTENANCE METHOD AND SYSTEM

FIELD OF THE INVENTION

The invention relates to electrographic printers and apparatus thereof and more particularly to an apparatus and method for controlling print quality using the development voltage.

BACKGROUND OF THE INVENTION

Electrographic printers and copiers utilizing developer comprising toner, carrier, and other components use a developer mixing apparatus and related processes for mixing the developer and toner used during the printing process. The term "electrographic printer," is intended to encompass electrophotographic printers and copiers that employ dry toner developed on an electrophotographic receiver element, as well as ionographic printers and copiers that do not rely upon an electrophotographic receiver. The electrographic apparatus often incorporates an electromagnetic brush station or similar development station, to develop the toner to a substrate (an imaging/photoconductive member bearing a latent image), after which the applied toner is transferred onto a sheet and fused thereon.

As is well known, a toner image may be formed on a photoconductor by the sequential steps of uniformly charging the photoconductor surface in a charging station using a corona charger, exposing the charged photoconductor to a pattern of light in an exposure station to form a latent electrostatic image, and toning the latent electrostatic image in a developer station to form a toner image on the photoconductor surface. The toner image may then be transferred in a transfer station directly to a receiver, e.g., a paper sheet, or it may first be transferred to an intermediate transfer member or ITM and subsequently transferred to the receiver. The toned receiver is then moved to a fusing station where the toner image is fused to the receiver by heat and/or pressure.

In the electrographic process, a dielectric member, such as a photoconductive element, is initially uniformly electrically charged. The electrostatic latent image charge pattern is formed on the dielectric member by exposing the dielectric member to a suitable exposure source. For example, if the dielectric member is a photoconductive element, the photoconductive element is exposed by an exposure source such as a laser scanner or an LED array. The latent image charge pattern is developed into a visible image by bringing the electrostatic latent image charge pattern into close proximity to a developer material such as contained in a magnetic brush or other known type of development station.

The developer material is typically formed of two or more components that include non-marking, magnetic, carrier particles and marking, non-magnetic toner particles. Because of the triboelectric interaction between the toner and carrier particles, the two types of particles develop charges of opposite polarity and the toner particles electrostatically adhere to the carrier particles. The development station delivers the developer in close proximity to the latent image charge pattern present on the dielectric member and the charged toner particles are attracted to and develop the latent image charge pattern.

Using an electrostatic field to urge the toner particles in the direction of the receiver member subsequently transfers the resulting toner particle developed image to a receiver member, such as paper or plastic sheet. The electrostatic field is commonly applied in one of several ways. For example, charge can be sprayed on the back of the receiver member using a corona device. However, it is frequently preferable to use an electrically biased transfer roller to apply the field. Upon completion of the transfer of the toner particle developed image to a receiver member, the developed image is fused to the receiver member by application of heat and/or pressure.

One of the larger contributors to image quality problems is the variation in environmental conditions that occurs in and around the development station. Warmers, driers, humidifiers and additives have been used to combat and control this problem, all with an eye to controlling the effect of the ambient environment on image quality. U.S. application publication No. 2004/0042815, published on Mar. 4, 2004 shows a humidification system for a development station to control charge on toner particles for developing a latent image charge patterns. Humidification is provided by adding water vapor to an airflow directed into the developer station. The addition of a humidification system is costly and also difficult to control. It would be preferable to have a developer station that did not need a humidification system to maintain image quality through the ambient environment range but instead adjusted a parameter internal to the development subsystem to maintain image quality.

SUMMARY OF THE INVENTION

The invention is for an apparatus and method to assist an electrographic printer in controlling print quality. More specifically, a method for maintaining print quality based on development potential measurements, said method including the steps of comparing the current process measurements to a toner concentration related set-point; calculating a quality adjustment range based on current process measurements and the toner concentration related set-point, or a derivative thereof, indicative of print quality; and adjusting current process conditions related to the current process measurements to trend towards a new set point within the quality adjustment range so that a rate of change is proportional to the difference between the current process measurements and the set point.

DETAILED DESCRIPTION OF THE INVENTION

Figure 1:
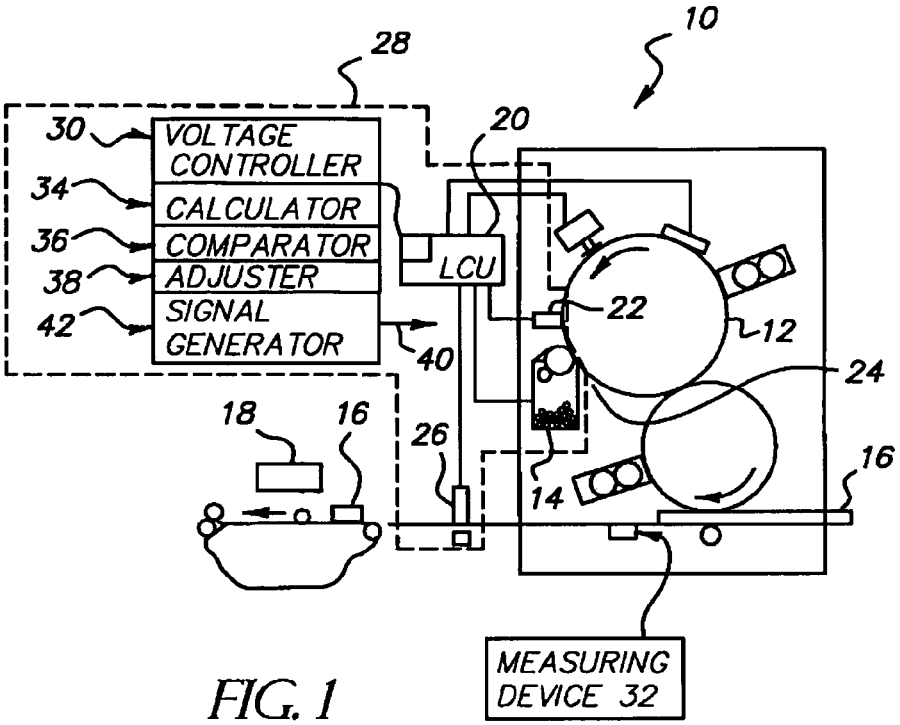
FIG. 1 is a schematic front view of a portion of an electrographic reproduction apparatus including a development station according to one aspect of the invention.
Figure 2:
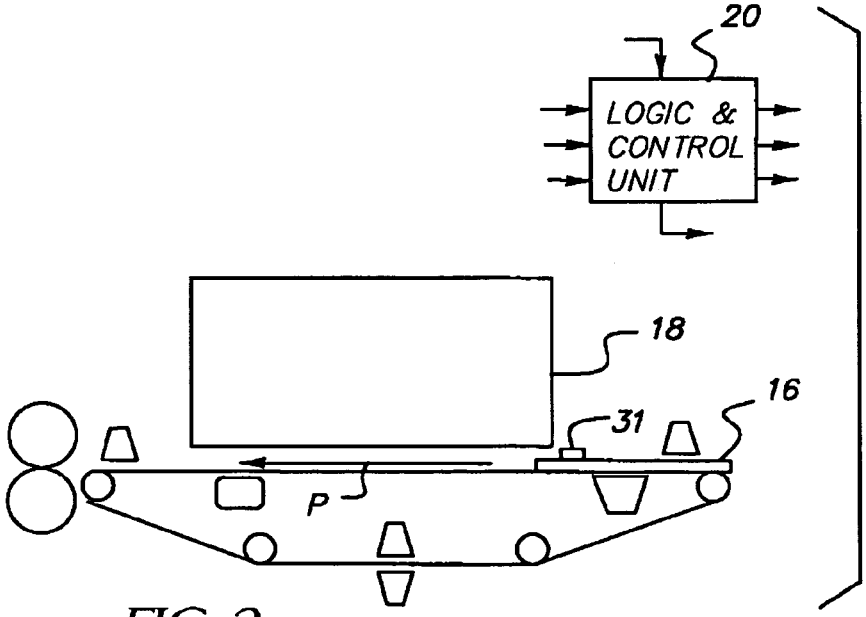
FIG. 2 is a schematic plan view of the portion of development station according to one aspect of the invention.

The present description will be directed in particular to elements forming part of, or cooperating more directly with, apparatus and methods in accordance with the present invention. It is to be understood that elements not specifically shown or described may take various forms well known to those skilled in the art FIGS. 1 and 2 show, generally schematically, a portion of an electrographic printer 10. The printer includes a moving electrographic imaging member shown here as a photoconductive drum 12, which is driven by a motor to advance the drum thus advancing the receiver 16 in the direction indicated by arrow P. Alternatively, drum 12 may be a belt that is wrapped around a drum or it may be a belt that is wrapped around one or more rollers. In the electrographic printer 10, a toner development station is provided for storing a supply of toner particles 14 and selectively depositing the toner particles on the photoconductive drum 12, which is also sometimes referred to as a photoconductor. When the charge on the toner particles is at a proper level, the particles will develop the latent image charge patterns into a high-quality visible image that is the correct charge level for the subsequent transfer step. Thereafter, the visible toner particle image is transferred to a receiver member 16, which is often referred to as a substrate or receiver, and is fixed to the receiver member by a fuser 18, to form the desired image. One skilled in the art understands that the receiver could be paper that is printed or non-printed or a non-paper, such as metal, ceramics, photoconductor, textile, glass, plastic sheet, metal sheet, paper sheet and other bases that are capable of receiving a toner or toner related material.

The electrographic printer 10 incorporates a printing quality controller device or apparatus 22 and system in accordance with the methods and systems described below. The electrographic printer 10 includes a controller or logic and control unit (LCU) 20 that is programmed to provide closed-loop control of printer 10 in response to signals from various sensors and encoders. Aspects of process control are described in U.S. Pat. No. 6,121,986 incorporated herein by this reference.

The quality controller device, generally indicated by 22, works in conjunction with the electrophotographic printer to control the charge on toner particles 14 in the development station of the electrographic printer 10, in order to assure high quality development of the latent image charge pattern carried by the latent image charge pattern carrying member, here after referred to as the photoconductive drum 12, prior to transfer of the toner particle developed image to a receiver member 16 transported in association therewith by any suitable transport mechanism. It has been determined that modifying the charge on the toner particles by adjusting a toner concentration 24 will maintain the development potential in a desirable range and achieve the required output print density for the desired high-quality image print without the need for a humidification system.

A print quality apparatus 28 operates in conjunction with an electrophotograhic printer without a humidification system. The quality control device 22 is a device for maintaining print quality based on development potential measurements (Vdev). The apparatus 28 includes a power supply 26 for charging a photoconductor to a photoconductor voltage (Vzero); a voltage controller 30 for determining and maintaining an aim Vzero, thereby causing, over the course of a specified time interval, a voltage control of the Vzero; one or more measurement devices 32 measure a first information including a photoconductor discharge speed and a residual voltage (toe voltage) of the Vzero, a processing system calculation device 34 for calculating a quality adjustment range based on current process measurements and the toner concentration related set-point, or a derivative thereof, which is indicative of print quality, such as the Vdev. A comparator 36 is also included wherein the first information, or a derivative thereof, is compared to the calculated quality adjustment range, or a derivative thereof, so that they are indicative of print quality; as well as an adjuster 38 to adjust the current conditions so they trend towards a new set point within the quality adjustment range in a controlled manner and a signal generator 40 for generating a signal based on the comparator and/or the adjuster, thus resulting in a better quality print.

Figure 4:
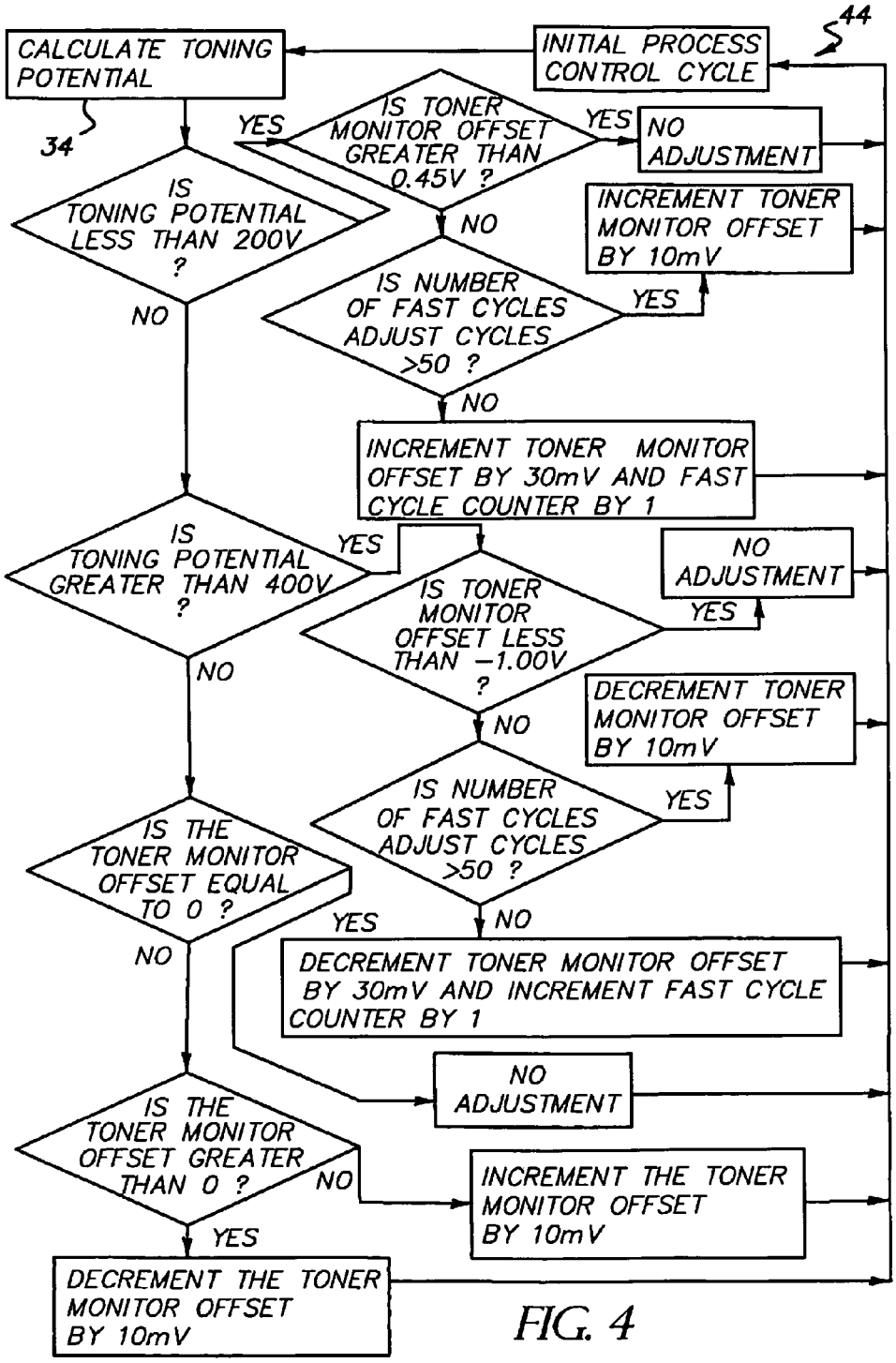
FIGS. 4-5 are graphical representations showing the process for controlling image quality according to one aspect of the invention.
Figure 5A:
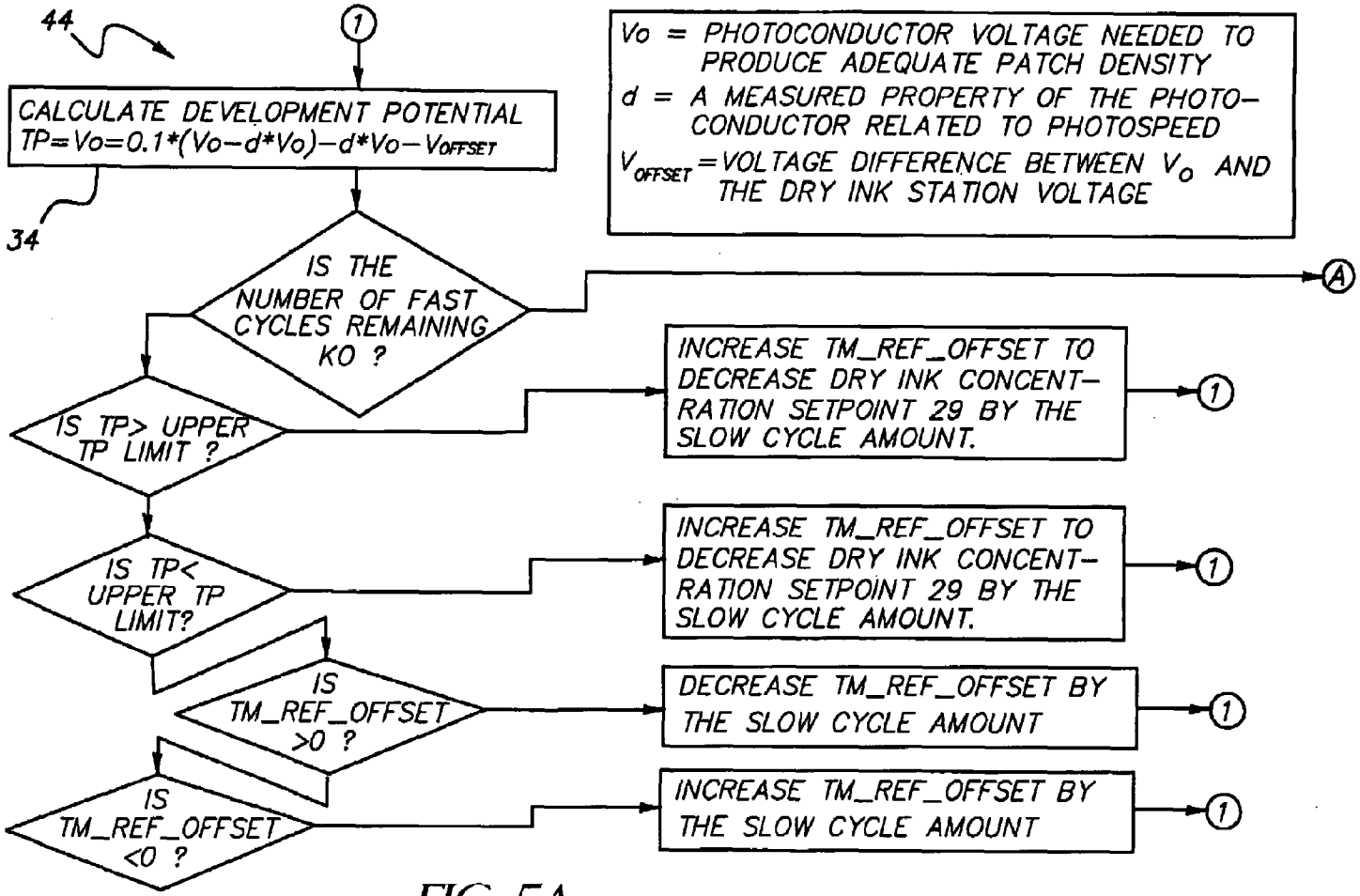
Figures 5, 5B:
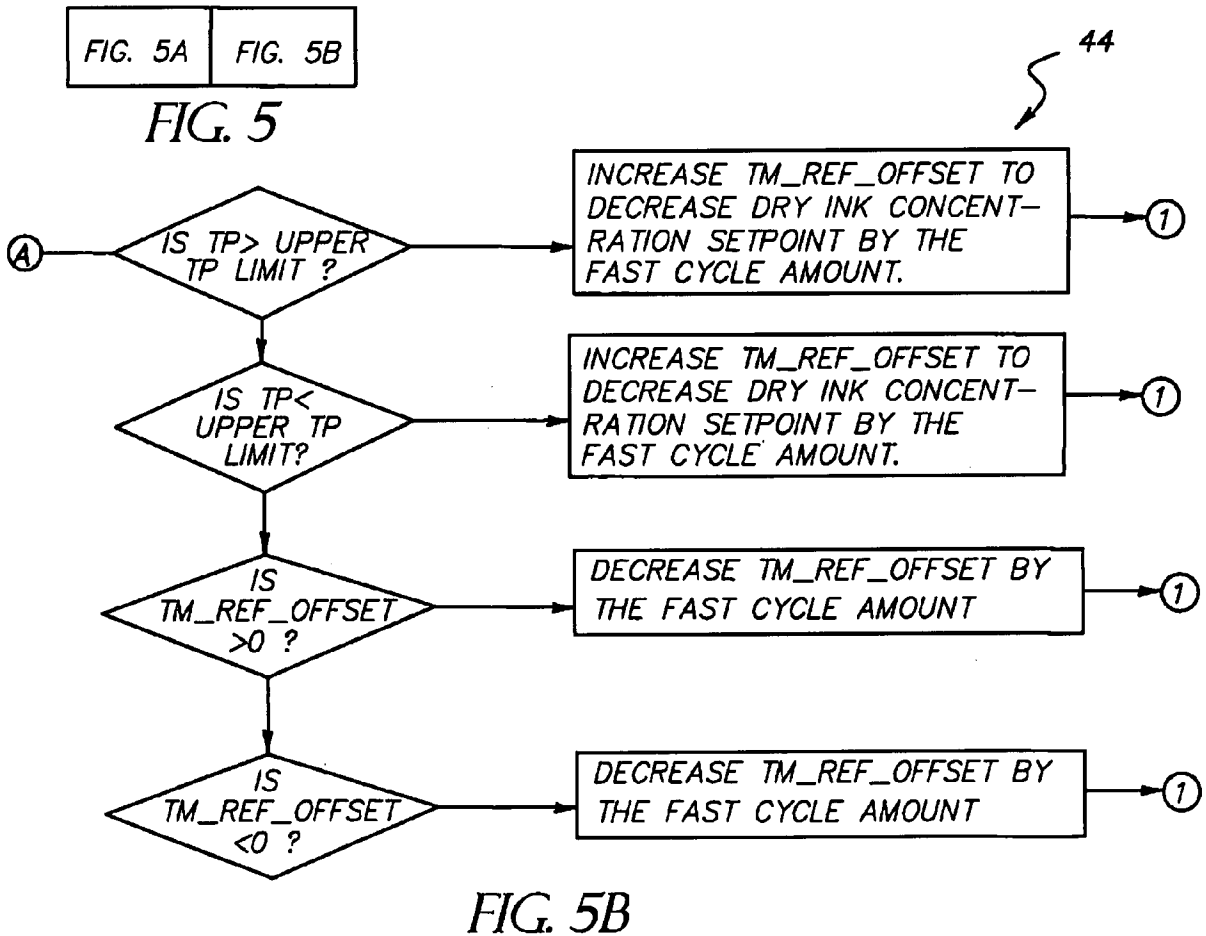

This apparatus 28 generates the signal 40 with the signal generator 42 that is controlled by a measuring device. One embodiment of a method 44 is represented by the flowcharts in FIGS. 3-5, for measuring at least one value related to said Vdev of said photoconductor during a time interval in which said Vdev is changing. The generated signal 40 is used to control toner concentration 24 by adding toner or withholding toner 14 and thus varying toner concentration based on one or more environmental factors including humidity, temperature, and air quality. A computer, which incorporates a control to activate the power supply, the adjuster, the comparator, and a toner, supply so that wherein the changes to the current set of conditions in a controlled manner related to a rate of change. This rate of change can be controlled by a set of rules that optimize performance.

Adjustment of the Aim Toner Concentration Based on Toning Potential

One preferred method 44 for maintaining print quality based on development potential measurements includes the steps of generating a print control patch 31 related to a toner concentration related set-point, which is an aim value that represents a desired or possibly, but not necessarily an ideal quality; receiving current process measurements including a measured toning potential related value and a measured toner concentration related (TM_ref) value; comparing the current process measurements to the toner concentration related set-point and calculating a difference; calculating a quality adjustment range based on current process measurements and the toner concentration related set-point, or a derivative thereof, indicative of print quality; adjusting current process conditions related to the current process measurements to trend towards a new set point within the quality adjustment range so that a rate of change is proportional to the difference; and generating a signal based on the comparison.

This method 44 sets the set point so that the quality adjustment range has a minimum and maximum. In a preferred embodiment, one important aspect is that the adjustment is made at a controlled rate of change such that the controlled rate of change is optimized based on a set of rules that are chosen based on current process conditions. The system will generate the signal based on a number of variables, including Vdev, which is used to control toner concentration 24 by adding toner or withholding toner. The signal generated would be able to change toner concentration based on one or more environmental factors including humidity, temperature, and air quality.

This method 44 will include the normal steps of charging the photoconductor 12 to Vzero and exposing the photoconductor to two light exposures (Ezero) to estimate photoconductor discharge speed and residual voltage (toe voltage) before generating the print control patches. Then print control parameters are adjusted, including the Vzero and Ezero. When the current process measurements are received for information, including the Vzero, Ezero, and residual voltage, a processor calculates development potential (Vdev) using this information and Vdev, or a derivative thereof, is then compared to a range of stored voltages indicative of print quality so that these variables can be reset to improve print quality based on the comparison.

There are many factors that influence the charge-to-mass of the toner, and among those factors are the toner concentration and the water content of the toner. The water content of the toner is dependent on the water content of the air to which the toner is exposed. Removal of a humidity control increases the charge-to-mass range of the toner and increases the external noise to which the system is exposed. Relative humidity insensitive toners have been developed, but these are not sufficient to limit the charge-to-mass to a range that will control the formation of transfer artifacts. The quality controller can control toner concentration to partially counteract the effect of variations in humidity. That is, when the humidity is low and the toner charge-to-mass increases the toner concentration is increased so that the toner charge-to-mass is reduced. When the humidity is high and the toner charge-to-mass is low, the toner concentration is decreased so that the toner charge-to-mass increases. Toner charge-to-mass tends to be inversely proportional to both toner concentration 24 and humidity.

In order to adjust the toner concentration 24 to compensate for the toner charge-to-mass, the toning potential is used as a substitute for the toner charge-to-mass, as the toner charge-to-mass cannot be directly measured in the digital press. The toning potential is the process parameter that is used by process control to control the image density. However, the toning potential is also not directly measured or controlled but must be inferred from measured photoconductor properties and other process control parameters. The photoconductor parameters are determined in the manner described by Buettner (U.S. Pat. No. 6,647,219). The photoconductor is uniformly charged to a voltage of −500V. Then exposures of 1.63 and 5.00 ergs/cm$^2$ are given to the photoconductor and the corresponding exposed voltages are measured by an electrostatic voltmeter. These two expose voltages are used to estimate the photodischarge speed and the residual voltage (toe voltage) of the photoconductor. Once the photoconductor speed and toe are known, the process control system prints density control patches and adjusts the photoconductor initial voltage (Vzero), the exposure, and the toning bias to provide the aim output density. From the process control parameters of Vzero, photoconductor toe, and the toning bias, the toning potential that is required to produce the aim output density under the current process conditions is calculated.

The toning potential is then tested to determine if it falls into a range that is consistent with a toner charge-to-mass that will not produce transfer artifacts or drive Vzero to values that are outside of the process control operating range. For example, the upper limit of the toning potential could be 400 V and the lower limit could be 200 V. If the toner concentration adjustment algorithm finds that the toning potential is greater than 200 V and less than 400 V, then the toner concentration will be adjusted to its nominal value (6% as an example). If the toning potential is greater than 400 V, the TC will be incrementally increased until the toning potential is equal to 400V or until an upper limit of the toner concentration is reached. If the toning potential is less than 200V, then the toner concentration will be decreased until the toning potential is equal to 200V or a lower limit for the toner concentration is reached. This algorithm is shown schematically in FIG. 3. The steps enclosed in the dashed rectangle are only executed at machine power up or after the machine has been on for about 10 hours. The steps outside the box are executed every process control cycle and the process control cycle is initiated every transport web revolution during active printing.

The toner concentration is controlled by enabling addition of toner or refraining from adding toner to the development station based on the difference between a toner monitor signal voltage and a reference voltage that is stored in the toner concentration control system. The toner monitor is adjusted so that the reference signal is approximately 2.5 V. The toner concentration adjustment algorithm does not change the toner monitor reference signal to effect the adjustment but rather increments or decrements a toner monitor offset parameter. The parameter is adjusted by a defined increment on each process control cycle where an adjustment of the toner concentration 24 is to be executed. Two differently sized increments are allowed. After the addition of a new developer mix, a larger increment or decrement of the toner monitor offset parameter is allowed for a selected number of process control cycles. After the selected number of process control cycles has been executed the increment reverts back to the smaller size that is normally used for the toner concentration control adjustment.

Figure 3:
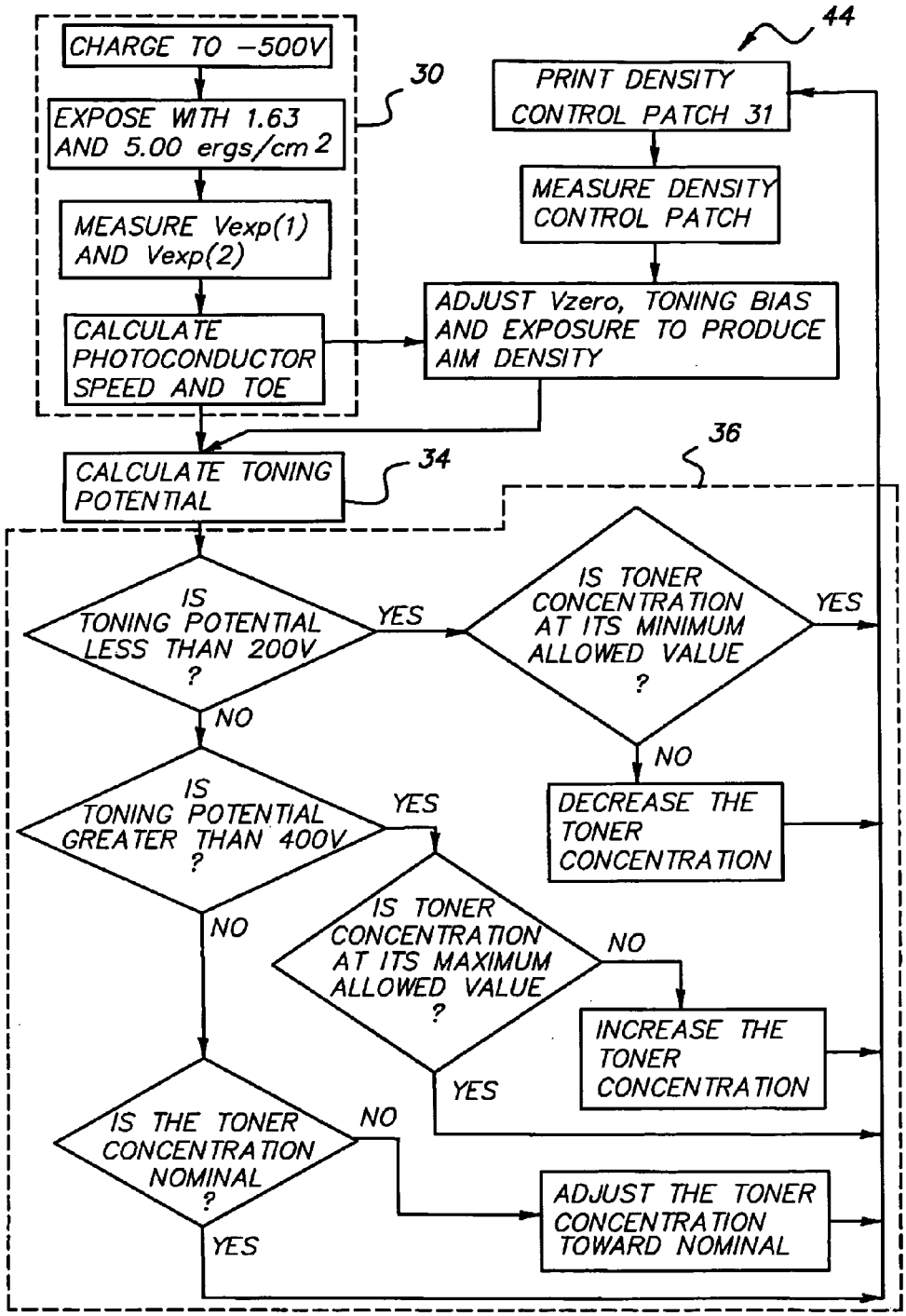
FIG. 3 is a flowchart for the process for controlling image quality.

A schematic diagram of this method 44 is shown in FIG. 3. More detail of the toner monitor offset adjustment and example values of the adjustable parameters of the method are described here and represented in FIG. 4. The minimum value of the toner monitor offset is −1.00V. This allows the toner concentration to increase by approximately 3%. The maximum value of the toner monitor offset is +0.45V and this allows the toner concentration to decrease by about 1.5% from its nominal value of 6%. The larger adjustment of the toner monitor offset used for fast toner concentration adjustment is 30 mV per process control cycle. This larger adjustment is used for the first 50 process control cycles following a developer addition. The smaller adjustment of the toner monitor offset is 10 mV per process control cycle.

In one preferred embodiment it is desirable to have asymmetric control to prevent the tendency for TC to rise with life as seen with previous developers in high humidity conditions. Given this characteristic, this embodiment starts with a toner concentration (TC) that is used as the minimum TC so that the controller adds toner to the aim concentration when needed, but never allows concentration to drop below this initialized level. This is done as follows:

a. TM_ref will be defined as the initialized value following a developer replacement procedure as always.

b. The aim value for TM_ref will be shifted to 2800 mV to account for the asymmetric TC control (previously 2500 mV is the target value).

c. TM_ref_offset_anchor will be defined as an offset to TM_ref which is valid at Vzero_initial. Vzero_initial is the photodischarge corrected starting points established during an automated process setup (APS). Vzero_initial generally corrects for photoconductor toe variation. The value of TM_ref offset_anchor can have a range of 0 to 1000 mV, default is equal to 350 mV (about 1% over nominal concentration, and would apply to nominal 500 v Vzero, +/−50 volts due to toe considerations).

d. TM_ref offset_slope is the nominal adjust rate used to calculate the instantaneous TM_ref offset_aim. This parameter is expressed as microvolts per Vzero volts and can have a range of 0 to 10,000, with a nominal value of 1,700 (results in 1% TC change over 200 Vzero range).

e. TM_ref_offset_min is a parameter to prevent the offset from exceeding a minimum value, which determines how low the minimum TC is offset from the build TC. The range for this parameter is −1000 to +1000, with a nominal value of 0. A value of zero means that the build TC is the minimum TC.

f. TM_ref_offset_max is a parameter to prevent the offset from exceeding a maximum value, which determines how high the maximum TC is offset from the build TC. The range of this parameter is −1000 to +1000, with a nominal value of +700.

Figure 6:
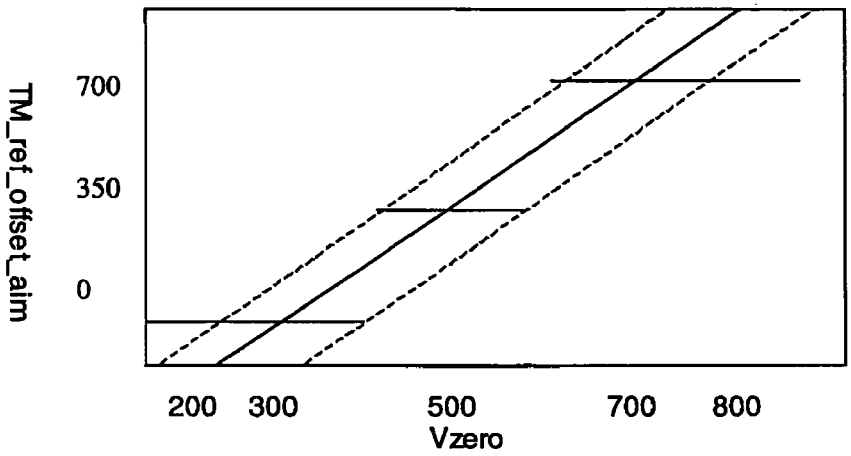
FIG. 6 is a graph illustrating the values of TM_ref_offset_aim versus the values of Vzero.

In this embodiment the TC is proportional to Vzero, but not allowed to change rapidly using the following steps:

a. TM_ref_offset_aim is defined as a Vzero dependent calculation, FIG. 6, which sets the aim TM_ref_offset_aim= . . . slope×(Vzero_aim−Vzero_initial)+TM_ref_offset_anchor. The value of this is allowed to adjust strictly according to the above relationship and is not subjected to min or max limits or step changes.

b. TM_ref_offset_actual is the operating TM_ref_offset, which is designed to converge on the TM_ref_offset_aim slowly by limiting the rate of adjustment in any one process patch cycle. This value is subjected to min and max limits as established by those parameters defined in e and f above.

c. TM_ref_offset_step_limit is the maximum allowed change to single TM_ref_offset_actual adjustment. This value is expressed as an absolute value, limiting positive and negative adjustments equally. The range for this parameter is 0 to 50, with a nominal value of 4, which leads to a maximum TC adjustment rate of 1% TC in 1925 prints (350 mV/%, 88 adjust cycles, 22 prints between adjustments).

In order to have a new developer converge on a mid-range TC before beginning any real-time control the additional steps are used:

a. When a developer is loaded, it is first stirred for a fixed time interval, then the fine tune electronic adjustment is made to drive TM_live to 2800, then the monitor is sampled for 20 seconds and an averaged monitor signal is stored as TM_ref.

b. Following this the TM_ref_offset_aim and TM_ref_offset_actual will be set equal to the TM_ref_offset_anchor.

c. The "add toner" service routine will then run to drive TM_cur to be adjusted to converge on the TM_ref−TM_ref_offset_actual. This action will nominally add 1% TC to this new developer. The starting TC could be based on feed-forward from an Rh sensor.

TC catch-up is scheduled when Vzero is near the values that correspond to the toning potential limits because when Vzero approaches the limits of control, it may be desirable to allow the TC to more rapidly catch up to the TM_ref_offset_aim. We have acknowledged that on the low side, when Vzero is below 300 volts that we are in a degraded quality regime. Therefore the potential instability effects of rapid TC catch up may be less objectionable than sustained operation in that condition. Likewise when Vzero exceeds 700 volts transfer artifacts are quite likely and generally the system is less stable. In these areas of operation, TC is allowed to adjust more rapidly using the following steps:

a. TM_ref_offset_Vzero_min and TM_ref_offset_Vzero_max are defined as threshold Vzero levels where catch up behavior kicks in. The range for these parameters is 250-800, the nominal min value is 300, and the max value is 700.

b. TM_ref offset_step_limit_catchup is a step limit value which applies to adjustments made when Vzero is operating below the min or above the max values described by 5*a*. The allowed range for this parameter is 0 to 50, with a nominal value of 35. This leads to a potential rate of TC adjustment of 1% within 220 prints.

The implementation of a check on whether a large adjustment of the toner concentration is necessary is described here. For example, this might be needed if the humidity was low as indicated by the system monitor 32 on Friday afternoon at the end of the day and high on Monday morning at machine startup. The need for the adjustments described in the following is yet to be determined. In order to execute the check, the toning potential from the previous setup would need to be stored and compared to the needed toning potential calculated during an automated process setup (APS) that would be executed at machine startup. If the change in required toning potential exceeded a threshold value, e.g. 200V, then the machine operator would be warned that process control limits were likely to be exceeded and color reproduction might be compromised unless the toner concentration is adjusted. The operator would be led to service routines to execute either a rapid addition of toner to the development station or a rapid removal of toner from the development station. The removal of toner 14 would be designed to collect a minimum amount of waste toner in the front side web cleaner.

Although the invention has been described and illustrated with reference to specific illustrative embodiments thereof, it is not intended that the invention be limited to those illustrative embodiments. Those skilled in the art will recognize that variations and modifications can be made without departing from the true scope and spirit of the invention as defined by the claims that follow. It is therefore intended to include within the invention all such variations and modifications as fall within the scope of the appended claims and equivalents thereof.

The invention claimed is:

1. Method for maintaining print quality based on development potential measurements, said method comprising the steps:

a. generating a print control patch related to a toner concentration related set-point;

b. receiving current process measurements including a measured toning potential related value and a measured toner concentration related (TM_ref) value;

c. comparing the current process measurements to the toner concentration related set-point; and calculating a difference;

d. calculating a quality adjustment range based on current process measurements and the toner concentration related set-point, or a derivative thereof, indicative of print quality;

e. adjusting current process conditions related to the current process measurements to trend towards a new set point within the quality adjustment range so that a rate of change is proportional to the difference between the current process measurements and the set point; and f. generating a signal based on the comparison.

2. Method of claim 1, wherein the quality adjustments range has a minimum and maximum.

3. Method of claim 1, wherein the adjustment is made at a controlled rate of change.

4. Method of claim 3, wherein the controlled rate of change is optimized based on a set of rules that are chosen based on current process conditions.

5. Method of claim 1, wherein the generated signal, based on Vdev, is used to control toner concentration by adding toner.

6. Method of claim 1, wherein the generated signal, based on Vdev, is used to control toner concentration by withholding toner.

7. Method of claim 1, wherein the generated signal is used to decrease toner concentration by withholding toner, based on one or more environmental factors including humidity, temperature, and air quality.

8. Method of claim 1, wherein the generated signal is used to increase toner concentration by adding toner, based on one or more environmental factors including humidity, temperature, and air quality.

9. An electrophotographic printer without a humidification system, including an apparatus for maintaining print quality based on development potential measurements (Vdev), said apparatus comprising:

a. a power supply for charging a photoconductor to a photoconductor voltage (Vzero);

b. a voltage controller for said Vzero, thereby causing, over the course of a time interval, voltage control of said Vzero;

c. one or more measurement devices to measure a first information including a photoconductor discharge speed and a residual voltage (toe voltage) at said Vzero;

d. processing system device for calculating a quality adjustment range based on current process measurements and the toner concentration related set-point, or a derivative thereof, indicative of print quality, such as the Vdev;

e. a comparator wherein a first information, or a derivative thereof, is compared to the calculated quality adjustment range, or a derivative thereof, indicative of print quality;

f. an adjuster to adjust the current conditions so they trend towards a new set point within the quality adjustment range in a controlled manner; and g. a signal generator for generating a signal based on the comparator and/or the adjuster.

10. Apparatus of claim 9, wherein said generated signal is controlled by a measuring device for measuring at least one value related to said Vdev of said photoconductor during a time interval in which said Vdev is changing.

11. Apparatus of claim 9, wherein said generated signal is used to control toner concentration by adding toner.

12. Apparatus of claim 9, wherein said generated signal is used to control toner concentration by withholding toner.

13. Apparatus of claim 9, wherein said generated signal controls toner concentration, based on one or more environmental factors including humidity, temperature, and air quality.

14. Apparatus of claim 9, including a computer which incorporates said means for activating said power supply, the adjuster, the comparator, and said means for activating or deactivating a toner supply.

15. Apparatus of claim 9, wherein the quality adjustment range has a minimum and maximum.

16. Apparatus of claim 9, wherein the controlled manner relates to a rate of change.

17. Method for maintaining print quality, said method comprising the steps:

a. charging the photoconductor and determining current process conditions, including print control parameters such as Vzero, Vdev, and residual voltage (toe voltage);

b. generating print control patches;

c. comparing the current process conditions, including Vdev, or a derivative thereof, to a quality adjustment range based on current process conditions and a toner concentration related set-point, or a derivative thereof, indicative of print quality; and calculating a difference;

d. adjusting the print control parameters in a controlled manner towards a new set point within the quality adjustment range so that a rate of change is proportional to the difference; and e. generating a signal based on the comparison.

18. Method of claim 17, wherein a generated signal controls toner concentration by adding toner.

19. Method of claim 17, wherein a generated signal controls toner concentration by withholding toner.

20. Method of claim 17, wherein the quality adjustments range has a minimum and maximum.

21. Method of claim 17, wherein the adjustment is made at a controlled rate of change.

22. Method of claim 21, wherein the controlled rate of change is optimized based on a set of rules that are chosen based on current process conditions.

* * * * *